US005082509A

United States Patent [19]

Ushigami et al.

[11] Patent Number: 5,082,509

[45] Date of Patent: Jan. 21, 1992

[54] METHOD OF PRODUCING ORIENTED ELECTRICAL STEEL SHEET HAVING SUPERIOR MAGNETIC PROPERTIES

[75] Inventors: Yoshiyuki Ushigami; Toyohiko Konno; Yozo Suga; Kiyoshi Ueno, all of Kitakyushu; Mikio Itoh; Toshio Nishiyama, both of Himeji; Kenichi Takimoto, Kitakyushu, all of Japan

[73] Assignee: Nippon Steel Corporation, Tokyo, Japan

[21] Appl. No.: 508,772

[22] Filed: Apr. 12, 1990

[30] Foreign Application Priority Data

Apr. 14, 1989 [JP] Japan ..... 1-94414
May 22, 1989 [JP] Japan ..... 1-128423

[51] Int. Cl.[5] ..... H01F 1/04
[52] U.S. Cl. ..... 148/111; 148/113
[58] Field of Search ..... 148/111, 113

[56] References Cited

U.S. PATENT DOCUMENTS

| | | | |
|---|---|---|---|
| 1,965,559 | 7/1934 | Goss | 148/113 |
| 3,159,511 | 12/1964 | Taguchi et al. | 148/113 |
| 3,163,564 | 12/1964 | Taguchi et al. | 148/113 |
| 3,932,234 | 1/1976 | Imanaka et al. | 148/112 |
| 4,200,477 | 4/1980 | Datta et al. | 148/113 |
| 4,268,326 | 5/1981 | Iwayama et al. | 148/113 |
| 4,576,658 | 3/1986 | Inokuti et al. | 148/111 |
| 4,632,708 | 12/1986 | Konno et al. | 148/113 |
| 4,875,947 | 10/1989 | Nakayama et al. | 148/113 |
| 4,929,286 | 5/1990 | Komatsu et al. | 148/111 |

FOREIGN PATENT DOCUMENTS

| | | | |
|---|---|---|---|
| 0318051 | 5/1989 | European Pat. Off. | 148/111 |
| 1-139722 | 6/1989 | Japan . | |

OTHER PUBLICATIONS

May et al., "Secondary Recrystallization in Silicon Steel" *Trans. of Met. Soc. of AIME*, vol. 212, 1958, pp. 769–781.

Matsuoka, "Effect of Impurities on Secondary Recrystallization in Silicon Iron", *Iron and Steel*, vol. 53, 1966, pp. 1007–1023.

Kuroki et al., "Effect of Precipitation Annealing in the (110)[001] Secondary Recrystallization of 3%Si-Fe", *Japanese Inst. of Metals*, 1979, pp. 419–424.

Saito, "Effect of Minor Elements on Normal Grain Growth in Singly Oriented Si Steel", vol. 27, 1963, pp. 186–195, *Japanese Met. Soc. J.*

Kuroki et al., "Inhibitors for Grain Oriented Silicon Steel", *Japanese Met. Soc. J.* vol. 43, 1979, pp. 175–181.

*Primary Examiner*—John P. Sheehan
*Attorney, Agent, or Firm*—Kenyon & Kenyon

[57] ABSTRACT

A method of producing an oriented electrical steel sheet having superior magnetic properties comprises the steps of, hot rolling a slab containing 0.8 to 6.8% of Si, 0.008% of Al acid soluble, the balance being Fe and accompanying impurities, by weight to form a strip, cold rolling the strip, primary-recrystallization annealing, coating the strip with an annealing separator, and finishing annealing, a nitriding treatment being effected after the primary recrystallization annealing but before the start of the secondary recrystallization of the finishing annealing. According to the present invention, with an atmosphere oxidizing degree ($PH_2O/PH_2$): x in a soaking process in said primary recrystallization annealing an annealing is effected in an atmosphere which has an oxidizing degree ($PH_2O/PH_2$): y in a range defined by the following inequality, at a temperature ranging from 650° to 800° C. in the heating process, for at least 5 secs.

$$0.15 \leqq x \leqq 0.80$$
$$0.15 \leqq y \leqq 0.80$$
$$0.16x + 0.11 \leqq y \leqq -0.41x + 0.78.$$

16 Claims, 5 Drawing Sheets

METHOD OF PRODUCING ORIENTED ELECTRICAL STEEL SHEET HAVING SUPERIOR MAGNETIC PROPERTIES

BACKGROUND OF THE INVENTION

1. Field of the Invention

The present invention relates to a method of producing an oriented electrical steel sheet having superior magnetic properties, and more particularly, relates to a method of producing a grain oriented electrical steel sheet having a Goss crystal orientation expressed by the Miller Index as a {110}<001> orientation in which the {110} plane is parallel to the surface of a steel sheet and the <100> axis coincides with the rolling direction, or a double oriented electrical steel sheet having a Goss crystal orientation expressed by the Miller Index as a {100}<001> orientation.

These steel sheets having a superior magnetic property can be used as the core of a transformer and a generator, etc.

2. Description of the Related Art

The oriented electrical steel sheet is formed, as explained above, of a required oriented crystal grain and having a sheet thickness of 0.10 to 0.35 mm, and usually containing 4.5% or less of Si.

The oriented electrical steel sheet requires a good excitation property and a watt loss property as the magnetic properties thereof, and to obtain an oriented electrical steel sheet having superior magnetic properties, the orientation of the crystal grain must be precisely aligned. A high densification of the crystal orientation can be realized by using a grain growth phenomenon known as secondary recrystallization.

To control the secondary recrystallization, a control of a primary recrystallization structure before the secondary recrystallization and a control of a fine precipitate, called an inhibitor or grain segregation type element, are indispensable. The inhibitor prevents the growth of a general primary recrystallized grain in a primary recrystallized structure and causes a selective growth of crystal grains having a special orientation.

As a typical precipitate, M. F. Littmann (Japanese Examined Patent Publication (Kokoku) No. 30-3651) and J. E. May, D. Turnbull (Trans. Met. Soc. AIME 212 (1958) p. 769-781) propose MnS, Taguchi and Itakura (Japanese Examined Patent Publication (Kokoku) No. 40-15644) propose AlN, and Imanaka et al (Japanese Examined Patent Publication (Kokoku) No. 51-13469 MnSe, and Komatsu et al, propose (Al, Si)N respectively.

On the other hand, as grain boundary segregation type elements, Saito propose Pb, Sb, Nb, Ag, Te, Se, S, etc., in the Japanese Metal Society Journal 27 (1963) P 186-195, but these elements are merely used as an auxiliary of the precipitate type inhibitor in the industrial process.

Although the conditions necessary to realize the functions of the inhibitor are not clear, taking into account the results of Matsuoka ("Iron and Steel" 53 (1967) p 1007-1023) and Kuroki et al (Japanese Metal Society Journal 43 (1979) p. 175-181 and 44 (1980) p. 419-424 the conditions appear to be as follows.

(1) Before the secondary recrystallization an amount of fine precipitates sufficient to prevent the growth of the primary recrystallized grain exists.

(2) The size of the precipitates is large to a certain degree, and it is not thermally rapidly changed in the secondary recrystallization annealing process.

Three methods of producing a typical grain oriented electrical steel sheet are well known, as follows.

The first method is carried out by a two stage cold-rolling process using MnS as an inhibitor, and this method is disclosed in the Japanese Examined Patent Publication (Kokoku) No. 30-3651 by M. F. Littmann. The second method is carried out by a process comprising a finishing cold rolling at a reduction ratio of 80% or more using AlN+MnS as an inhibitor, and is disclosed in Japanese Examined Patent Publication (Kokoku) No. 40-15644 by Taguchi and Sakakura. The third method is carried out by a two stage cold rolling process using MnS (or MnSe) + Sb as an inhibitor, and is disclosed in the Japanese Examined Patent Publication (Kokoku) No. 51-13469 by Imanaka.

In these production techniques, to a complete solid-dissolving of the inhibitor by heating at a high temperature of approximately 1400° C. before the hot-rolling of slabs is a basic requirement for obtaining a sufficient amount of precipitates, and a miniaturization thereof. Nevertheless, the following problems arise when heating slabs at a high temperature.

(1) a high temperature slab heating furnace for only the oriented electrical steel sheet is needed.

(2) The energy consumption of the heating furnace is high and expensive.

(3) The oxidation of the slab surface is advanced, a melt called a slag is generated, the maintenance time for the heating furnace is increased, with the result that the maintenance costs become high and the furnace operating ratio is lowered.

To realize a low temperature slab heating overcoming the above problems, an inhibitor formation technique in which the high temperature slab heating is not used is required.

Some of the present invention proposed a method of producing an oriented electrical steel sheet wherein an inhibitor is formed by nitriding a steel sheet having a finishing thickness. A grain oriented electrical steel sheet and a double oriented electrical steel sheet are disclosed in Japanese Examined Patent Publication (Kokoku) No. 62-45285 and Japanese Unexamined Patent Publication (Kokai) No. 1-139722 respectively.

In these techniques, it is important that the inhibitor be uniformly precipitated in the surface of the steel sheet by a nitriding, but when the steel sheets are produced on an industrial scale, if the nitriding is nonuniformly effected in a length direction of strip and a width direction thereof, the magnetic properties of the products become nonuniform.

The rate-determining step of the nitriding is a reaction in the surface of the strip (steel sheet), and thus to obtain a uniform and stable nitriding it is important to control the oxidized layer formed on the surface in the primary recrystallization annealing.

The oxidized layer form a forsterite film in the finishing annealing process, by a chemical reaction with MgO coated on the surface of the steel sheet as the annealing separator. The forsterite film functions such that, when the products are used as a transformer in a stacked state. An isolation between the steel sheet is ensured, a tension can be provided thereto, and the watt loss property can be improved.

SUMMARY OF THE INVENTION

An object of the present invention is to provide a method of forming an oxidized layer having a superior nitriding ability on a surface of an oriented electrical steel sheet.

Another object of the present invention is to provide a method of producing an oriented electrical steel sheet having superior magnetic properties wherein, in a primary recrystallization annealing process, an oxide layer having a stable nitriding ability and causing a stable formation of a forsterite film, is formed.

Accordingly there is provided a method of producing an oriented electrical steel sheet having superior magnetic properties, comprising the steps of: hot rolling a slab containing 0.8 to 6.8% of Si, 0.008% to 0.48% of Al acid soluble and the balance of Fe with accompanying impurities by weight to form a strip, cold rolling the strip, primary-recrystallization annealing, coating the strip with an annealing separator and finishing annealing, a nitriding treatment being effected after said primary recrystallization annealing but before the start of the secondary recrystallization of the finishing annealing, wherein an atmosphere oxidizing degree ($PH_2O/PH_2$) in the primary recrystallization annealing process is defined as within a range of from 0.15% to 0.8%.

There is further provided a method of producing an oriented electrical steel sheet having superior magnetic properties, comprising the steps of: hot rolling a slab containing 0.8 to 6.8% of Si, 0.008% to 0.48% of Al acid soluble and the balance of Fe with accompanying impurities by weight to form a strip, cold rolling the strip, primary-recrystallization annealing, coating the strip with an annealing separator, and finishing annealing, a nitriding treatment being effected after said primary recrystallization annealing but before the start of the secondary recrystallization of the finishing annealing, wherein with an atmosphere oxidizing degree ($PH_2O/PH_2$): x in a soaking process in the primary recrystallization annealing, an annealing is effected in an atmosphere having an oxidizing degree ($PH_2O/PH_2$) y in a range defined by the following inequality, at a temperature ranging from 650° to 800° C. in the heating process, for at least 5 secs.

$$0.15 \leqq x \leqq 0.80$$
$$0.15 \leqq y \leqq 0.80$$
$$0.16x + 0.11 \leqq y \leqq -0.41x + 0.78$$

DESCRIPTION OF THE PREFERRED EMBODIMENTS

The present inventors carried out an intensive investigation of the effects of the conditions of the primary recrystallization annealing on the nitriding of the sheet steel, and found that an oxidized surface layer having superior nitriding ability can be formed by defining an atmosphere oxidizing degree ($PH_2O/PH_2$) in a primary recrystallization annealing process.

This finding was obtained from the following experiment.

After annealing a hot-rolled steel sheet consisting essentially of 3.3% of Si, 0.027% of Al acid soluble, 0.008% of N, 0.14% of Mn, the balance of Fe with accompanying impurities by weight, the steel sheet was cold rolled to a finishing thickness of 0.20 mm. The steel sheet was then subjected to a primary recrystallization annealing in an atmosphere in which the oxidizing degree ($PH_2O/PH_2$) was changed in a range of from 0.02 to 1.0, and thereafter, an annealing separator mainly composed of MgO was coated on the steel sheet, and the sheet was subjected to a finishing annealing.

The finishing annealing was carried out by the steps of heating the sheet to 1200° C. in an atmosphere of 25% $N_2$+75% $H_2$, and annealing for purification for 20 hours in an atmosphere of 100% $H_2$.

The nitriding behavior of a strip coil (steel sheet) in the heating process, and the product properties, were then investigated.

Figure 1:
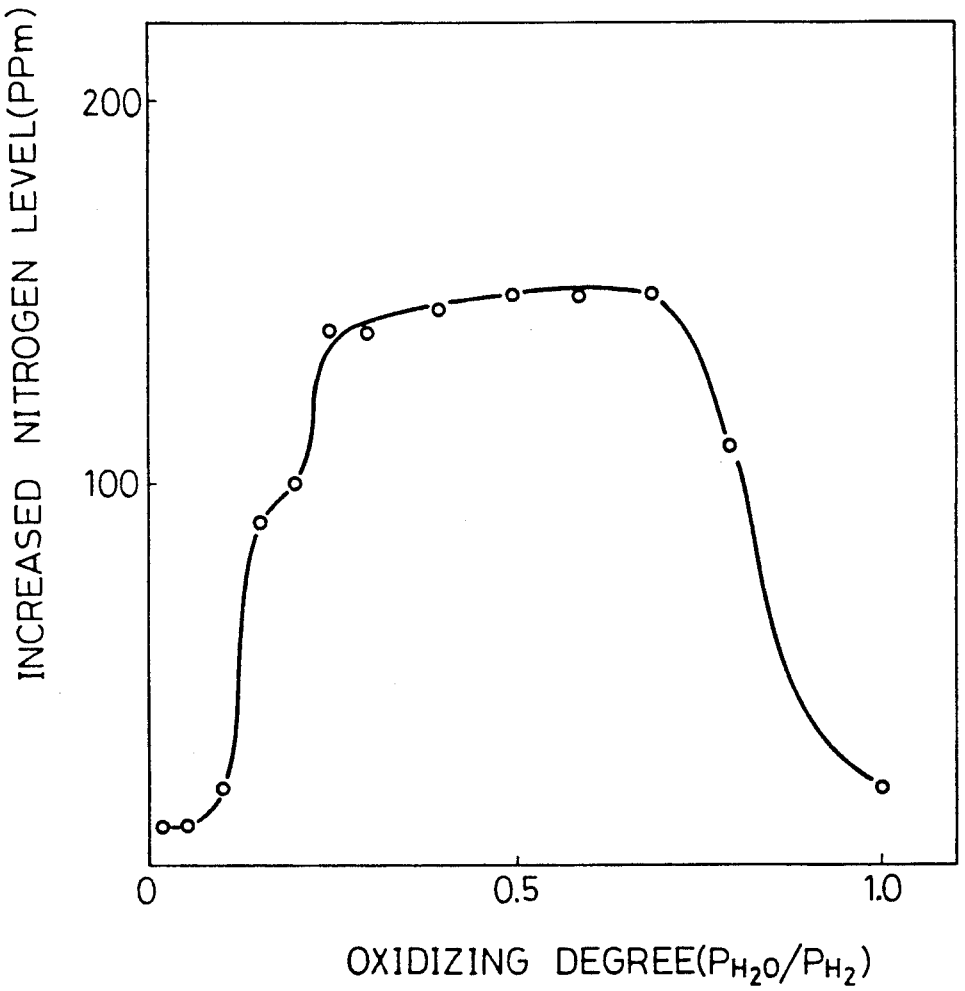
FIG. 1 is a view illustrating a relationship between an amount of increased nitrogen (increased nitrogen level at 850° C. in the finishing annealing where an amount of nitrogen in a steel sheet becomes maximum, and an oxidizing degree ($PH_2O/PH_2$) of an atmosphere in a primary recrystallization annealing.

FIG. 1 shows a relationship between an amount of increased nitrogen (increased nitrogen level) at 850° C. at which an amount of nitrogen in a steel sheet becomes maximum and an oxidizing degree ($PH_2O/PH_2$) of an atmosphere in a primary recrystallization annealing.

As apparent from FIG. 1, the steel sheet is stably nitrided in the oxidizing degree ($PH_2O/PH_2$) of an atmosphere of 0.15 to 0.80 preferably 0.25 to 0.70.

Figure 2:
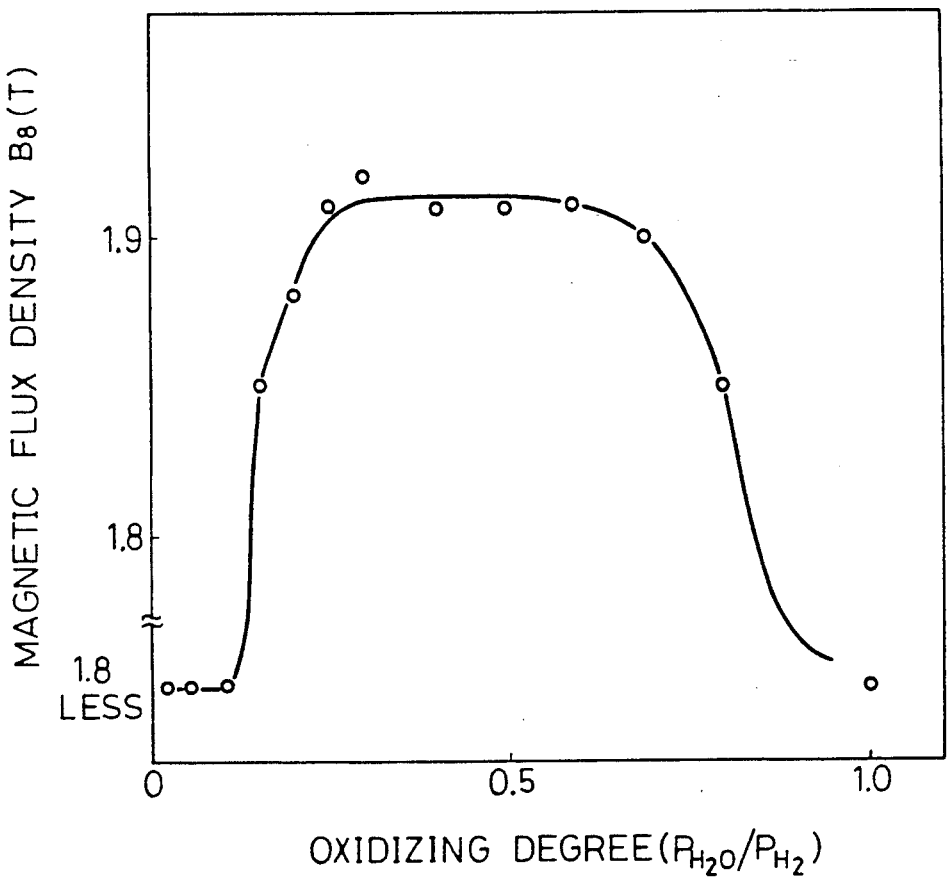
FIG. 2 is a view showing a relationship between the annealing oxidizing degree ($PH_2O/PH_2$) in the primary recrystallization annealing and the magnetic properties of the products.

The magnetic flux density (value of $B_8$) of the product becomes high in accordance with the amount of the increased nitrogen, as shown in FIG. 2.

Nevertheless, the present inventors found that, when the oxidizing degree ($PH_2O/PH_2$) of the atmosphere is increased, a spot defect is generated in a forsterite film on the steel sheet, an oxide, i.e., $Al_2O_3$, remains in the steel just under the forsterite film, and that it is difficult to coexist the nitridation of the steel sheet and the formation of the forsterite film thereon.

The present inventors investigated the problems of the formation of the forsterite, and found that the above-mentioned problem is arises when the amount of oxygen is increased.

The reason for this is thought to be that an excessive amount of oxygen more than the amount of oxygen necessary for forming a forsterite film, which is obtained by reacting MgO therewith, is gasified in the finishing annealing while acting on the defects in the steel as a starting point, and the oxygen is reacted with Al to form $Al_2O_3$.

Therefore, it is necessary to form an oxide layer having an improved nitriding activity while the amount of oxygen of the primary recrystallization annealed steel sheet is controlled below a specific level.

The present inventors found that the oxidizing behavior in the steel sheet in the heating process for the primary recrystallization plays an important role, and that by separately controlling the heating cycle and the oxidizing degree ($PH_2O/PH_2$) of an atmosphere in the heating process and the oxidizing degree ($PH_2O/PH_2$) of an atmosphere in the soaking process, an oxidized surface layer is obtained in which both a nitridation of the steel and a formation of a forsterite thereon can coexist.

This finding was obtained by the following experiments.

To determine an important temperature range in the heating process for the primary recrystallization annealing, a cold rolled steel sheet was rapidly heated to a temperature of from 500° to 850° C., at a heating rate of 100° C./sec in an atmosphere having an oxidizing degree ($PH_2O/PH_2$) of 0.25, maintained for 5 secs at the temperature, and rapidly heated again at the heating rate of 100° C./sec and annealed at 850° C.

Then an annealing separator was coated on the steel sheet, and a finishing annealing has carried out.

Figure 3:
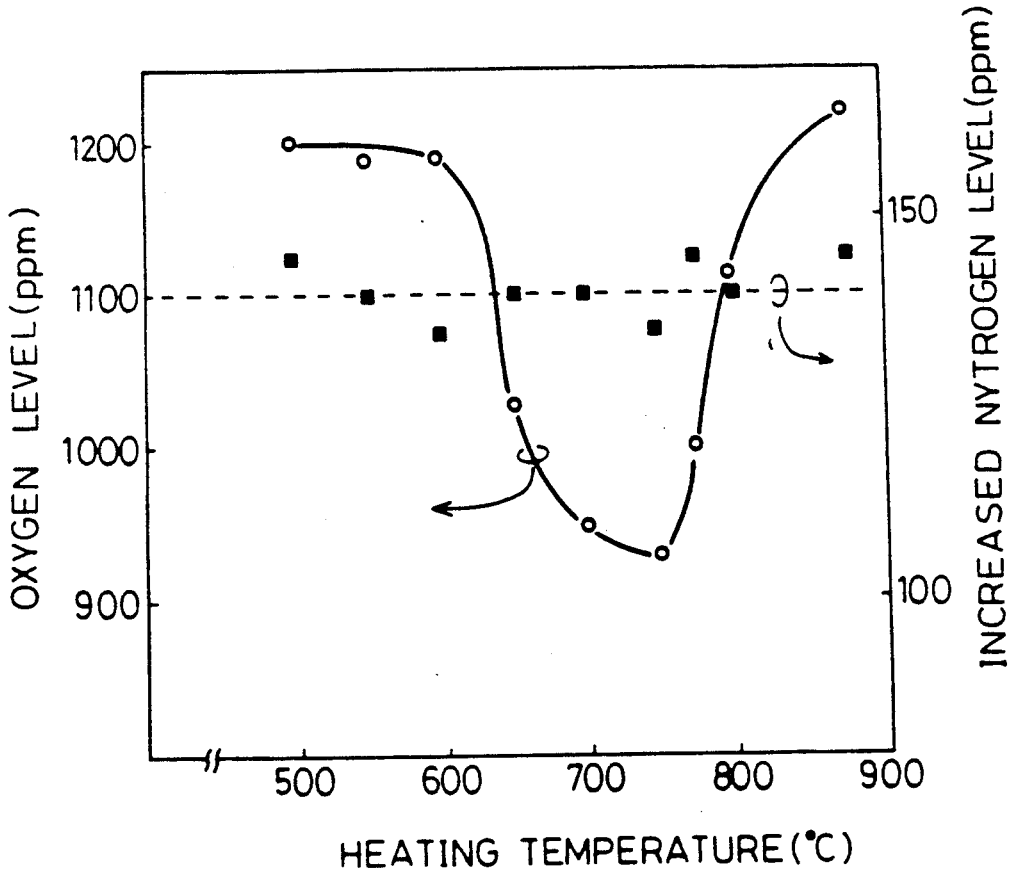
FIG. 3 is a view showing a relationship between a heating temperature of the steel sheet, and an amount of the oxygen (oxygen level) after the primary recrystallization annealing process and an amount of the increased nitrogen at 850° C. in the finishing annealing process.

FIG. 3 shows a relationship between a heating temperature of the steel sheet, and an amount of the oxygen (oxygen level) after the primary recrystallization annealing, and an amount of the increased nitrogen (increased nitrogen level) at 850° C. in the finishing annealing process.

It can be understood from FIG. 3 that, by maintaining a steel sheet at a temperature of from 650° to 800° C. for at least 5 secs, so that a primary oxide layer is formed, the oxidation after the subsequent uniform heating process is prevented, and thus the amount of the oxygen after the primary recrystallization annealing is reduced but the amount of nitrogen remains substantially constant and is not lowered.

Accordingly, the present inventors investigated effects of the oxidizing degree ($PH_2O/PH_2$) of the respective atmosphere in the heating process and the uniform heating process at a temperature and a time cycle in which the steel sheet is heated to 850° C. at a heating rate of 25° C./sec and annealed.

Figure 4:
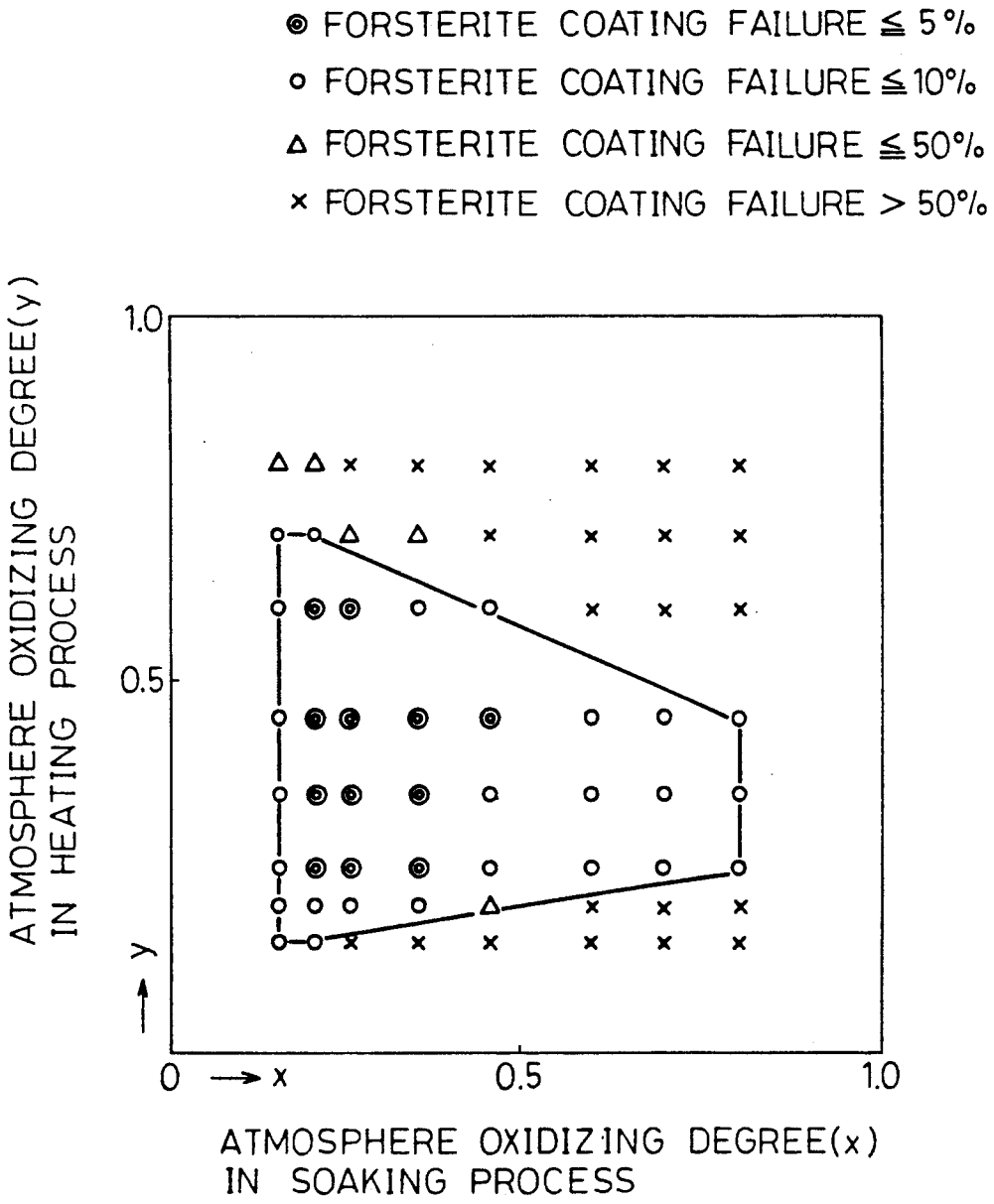
FIG. 4 is a view showing a relationship between the forsterite coating failure and the atmosphere oxidizing degree ($PH_2O/PH_2$) y in a heating process and the atmosphere oxidizing degree ($PH_2O/PH_2$) x in a soaking process; and, FIG. 5 is a view showing an equilibrium diagram of an oxide.

FIG. 4 shows a relationship between the oxidizing degree ($PH_2O/PH_2$) y of the atmosphere of the heating process and the atmosphere oxidizing degree ($PH_2O/PH_2$)x of in the uniform heating process, and the forsterite film state of a product.

From FIG. 4, it can be understood that the nitriding of the steel and the formation of the forsterite film thereon coexist in the following range of the inequality.

$$0.15 \leqq x \leqq 0.80$$
$$0.15 \leqq y \leqq 0.80$$
$$0.16x + 0.11 \leqq y \leqq -0.41x + 0.78$$

The inventors then investigated the heating rate of the steel sheet and the oxidizing degree of the atmosphere in the heating process, and found that, when the heating rate is high, the atmosphere oxidizing degree ($PH_2O/PH_2$) must be increased, but when the heating rate is low, the oxidizing degree may be kept at a low level. Namely, when the oxidizing degree is increased, the amount of the oxidation of the steel sheet is also increased. Thus, an oxide layer having a thickness larger than a predetermined level is obtained at a temperature ranging from 650° to 800° C., in a heating process.

The theoretical ground for these conceptions have not been fully clarified, but the inventors assume that they can be derived from the structures of the outer most layer of silica ($SiO_2$) and fayalite ($Fe_2SiO_4$).

Figure 5:
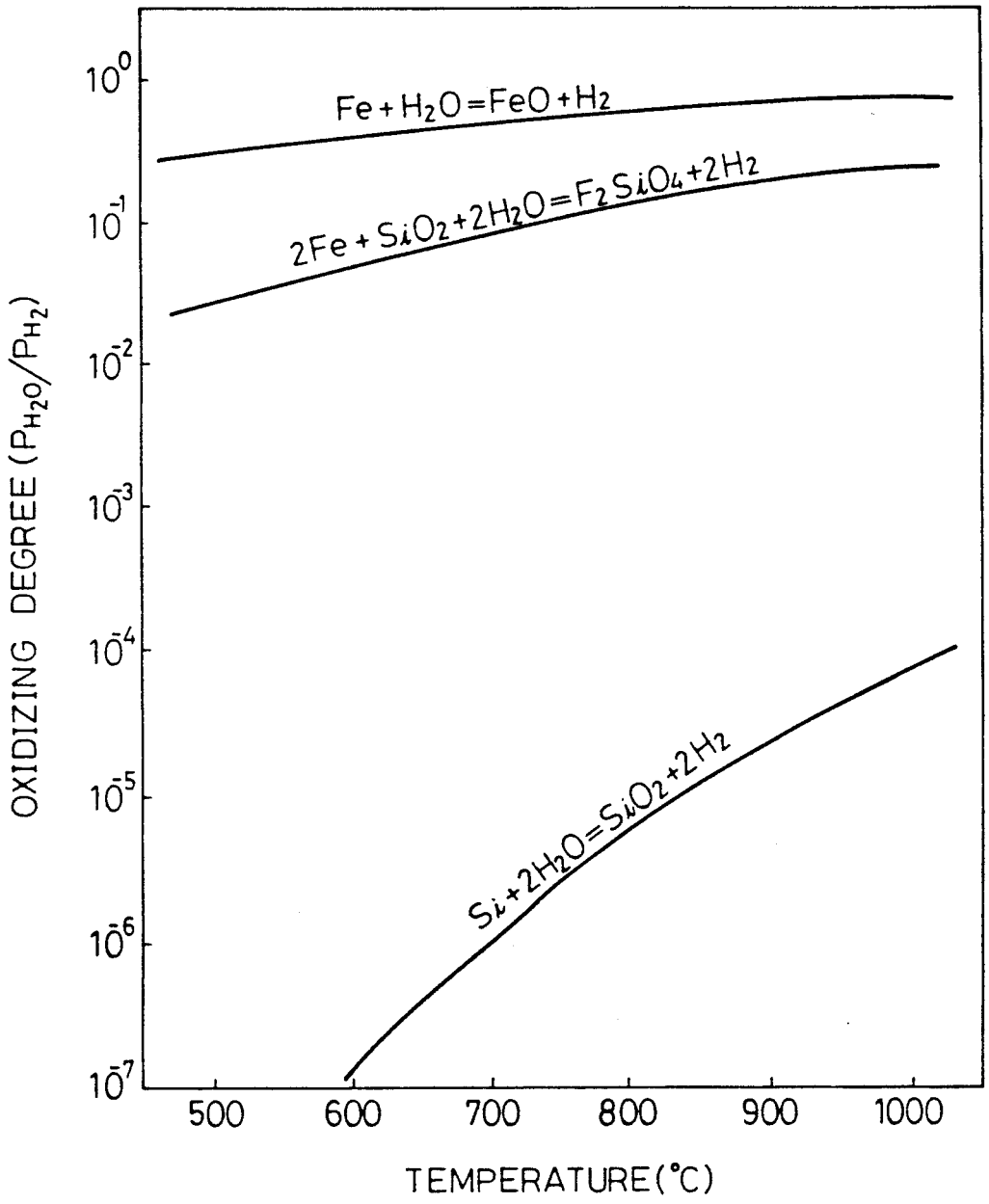

FIG. 5 shows an equilibrium diagram of an oxide. The restricted ranges of the present invention substantially correspond to a region of the formation of fayalite. Nevertheless, the inventors found, from an investigation using an infrared analysis, GDS analysis, etc., that silica and fayalite coexist and oxide has a nonuniform and is not in an equilibrium structure.

It is considered that the reason why nitridation is prevented at an oxidizing degree ($PH_2O/PH_2$) of less 0.15, from a nitriding behavior in a steel sheet, is that a uniform silica is formed in the outermost layer of the steel.

Further, it is considered that the reason why the nitriding ability of the steel sheet is lowered at an oxidizing degree of above 0.80 is that, when the atmosphere oxidizing degree becomes large, the ratio of fayalite in the outermost layer is increased, whereby the oxidizing is accelerated to cause the growth of an excessively thick oxidized layer.

Therefore, it is assumed that the upper limit of the atmosphere oxidizing degree is changed by the time required for the primary recrystallization annealing. Therefore, taking into account the time needed to complete the primary recrystallization, the upper limit of the atmosphere oxidizing degree was determined to be 0.80.

The outermost layer is formed in the heating process for the primary recrystallization, and the diffusion rate of Fe, Si, O, etc., which form an oxidized layer, is remarkably changed by a temperature, and structure of the oxidized layer is remarkably effected by the behavior of these elements. Therefore, the oxidizing behavior of the steel sheet in the heating process in the primary recrystallization annealing largely influences the formation of the structure of the outermost oxidized layer, and the oxidizing behavior in the subsequent soaking process.

As explained above, the gist of the present invention reside in separately controlling the heating process and the soaking process in the primary recrystallization annealing. Namely, in the heating process, the primary oxidized layer is controlled by defining the steel sheet staying time in a heating temperature ranging from 650° to 800° C. and the atmosphere oxidizing degree ($PH_2O/PH_2$), and in the soaking process, the growth of the oxidized layer is controlled by defining the atmosphere oxidizing degree ($PH_2O/PH_2$) with respect to the primary oxidized layer formed in the heating process, the nitriding is stably effected and an oxidized surface layer in which a fayalite film is properly formed is obtained.

In the present invention, the indispensable compositions of the stating material slab are 0.8 to 6.8% of Si, 0.008 to 0.048% of Al acid soluble, with the balance being Fe and accompanying impurities, by weight.

Si enhances the electrical resistance of the product and lowers the watt loss, thereby advantageously enhancing the properties, but when the content of Si exceeds 4.8% the cold rolling of the slab cannot be effected. Further, when the content of Si exceeds 6.8% cracking easily occurs even under a hot rolling, and thus such a rolling cannot be carried out.

On the other hand, when the content of Si is decreased, an $\alpha \rightarrow \gamma$ transformation in the steel is generated in a finishing annealing process and the crystal orientation property is lost. Therefore, 0.8% of Si whereby the $\alpha \rightarrow \gamma$ transformation is not generated at 950° C., is defined as the lower limit of the content of Si.

The Al acid soluble becomes AlN or (Al, Si)N by combining with N and acts as an inhibitor.

Particularly, to form the inhibitor by the nitridation of the primary recrystallization annealed steel sheet the Al acid soluble, which exists as a free Al, is required. The range of the content of the Al acid soluble is 0.008 to 0.048% by weight, where the magnetic flux density is increased.

Additionally, as the elements which form the inhibitor, Mn, S, Se, B, Bi, Nb, Sn, Ti, etc., can be added.

The heating temperature of the slab is preferably selected from ranges wherein Al and N is not completely solid-dissolved, from a view point of the formation of the inhibitor by the nitridation process of the steel sheet, as described in Japanese Examined Patent Publication (Kokoku) No. 62-45285. If the temperature becomes less than 1000° C., a flat sheet (strip) cannot be easily obtained in the hot rolling process. On the other hand, when the temperature exceeds 1270° C. the above-mentioned problem of the generation of slag arises. Consequently the range of the Al acid soluble is preferably defined as 1000° to 1270° C.

The heated slab is subsequently hot rolled and the hot rolled steel sheet is annealed, if necessary, at a temperature ranging from 750° to 1200° C., for 30 sec to 30 min.

Then, to obtain a desired finishing sheet thickness and texture, one or two or more stages of cold rolling, with annealing therebetween are carried out.

For a grain oriented electrical steel sheet, a finishing rolling with a reduction ratio of 80% or more is basically carried out, as disclosed in Japanese Examined Patent Publication (Kokoku) No. 40-15644. On the other hand, for the double oriented electrical steel sheet, a cold cross-rolling with a reduction ratio of 40 to 80% is carried out, as disclosed in Japanese Patent Publication (Kokoku) Nos. 35-2657 or 38-8218.

After the rolling process, a primary recrystallization annealing, which also serves for decarburization if carbon is contained in the steel, is carried out.

Thus, according to one aspect of the present invention, the oxidizing degree in the annealing process is defined as 0.15 to 0.80, preferably 0.25 to 0.70.

Further, according to another aspect of the present invention, the amount of oxygen in the primary recrystallization annealed steel sheet is controlled by a heat cycle and an atmosphere oxidizing degree ($PH_2O/PH_2$) in the heating process, and by an atmosphere oxidizing degree in the soaking process, in the primary recrystallization annealing, and an oxidized surface layer is obtained wherein a nitriding treatment of the steel sheet, effected after the primary recrystallization annealing but before the start of the secondary recrystallization in a finishing annealing is stably carried out.

An annealing separator mainly composed of MgO is coated on thus obtained steel sheet, and then a finishing annealing for a secondary recrystallization and purification is effected.

Above-mentioned nitriding treatment can be carried out by various processes, such as a process for enhancing the nitrogen partial pressure in the finishing annealing, a process adding a gas with the nitriding ability, e.g., ammonia gas, to an atmosphere, and a process of adding a metal nitride with the nitriding ability, e.g., manganese nitride, chromium nitride, etc., to an annealing separator.

EXAMPLE 1

Slabs containing 3.3% of Si, 0.025% of Al acid soluble, 0.008% of N, 0.14% of Mn, 0.007% of S, 0.05% of C, the balance being Fe and accompanying impurities, were heated to 1150° C., and then subjected to hot rolling to produce a hot rolled steel sheet having a thickness of 1.8 mm.

After the hot-rolled steel sheets were subjected to an annealing at 1100° C. for 2 min, they were subjected to a cold rolling with a reduction ratio of 63% in the same direction as the hot rolling direction, and subsequently, to a cold rolling with a reduction ratio of 55% in a direction crossing the above-mentioned cold rolling direction, so that steel sheets with a finish thickness of 0.30 mm were obtained. The thus-obtained cold rolled steel sheets were subjected to a primary recrystallization annealing, also serving for the decarburization, at 810° C. while changing the atmosphere oxidizing degree.

Then after coating the sheets with a MgO annealing separator, they were heated to 1200° C. at the heating rate of 15° C./hr in an atmosphere of 25% $N_2$+25% $H_2$, and purified at 1200° C. for 20 hours in an atmosphere of 100% $H_2$. The amount of the increase of nitrogen at a finishing annealing of 850° C., and the magnetic properties of the obtained products are shown in Table 1.

TABLE 1

| Oxidizing Degree ($PH_2O/PH_2$) | Amount of Increased Nitrogen (%) | Magnetic Flux Density ($B_8$:Tesla) Rolling Direction | Direction Crossing Rolling Direction |
|---|---|---|---|
| 0.05 | 0.001 | 1.54 | 1.51 |
| 0.20 | 0.008 | 1.88 | 1.85 |
| 0.30 | 0.011 | 1.91 | 1.90 |
| 0.40 | 0.015 | 1.92 | 1.92 |
| 0.70 | 0.014 | 1.92 | 1.91 |
| 1.00 | 0.005 | 1.83 | 1.84 |

EXAMPLE 2

Slabs containing 3.2% of Si, 0.027% of Al acid soluble, 0.007% of N, 0.13% of Mn, 0.007% of S, 0.05% of C, the balance being Fe and accompanying impurities, were heated to 1150° C., and then were subjected to hot rolling to produce a hot rolled steel sheet having a thickness of 1.8 mm.

After the hot-rolled steel sheets were subjected to an annealing at 1120° C. for 2 min, and subsequently, at 900° C. for 2 min, they were subjected to a cold rolling having a finish thickness of 0.20. The thus-obtained cold rolled steel sheets were subjected to a primary recrystallization annealing, also serving for the carburization, at 830° C. while changing the atmosphere oxidizing degree. Then the steel sheets were subjected to a nitriding treatment in an nitrogen atmosphere containing 3% of $NH_3$.

The relationship between the oxidizing degree in the primary recrystallization process and the amount of increased nitrogen is shown in Table 2.

TABLE 2

| Oxidizing Degree ($PH_2O/PH_2$) | Amount of Increased Nitrogen (%) |
|---|---|
| 0.05 | 0.002 |

TABLE 2-continued

| Oxidizing Degree ($PH_2O/PH_2$) | Amount of Increased Nitrogen (%) |
|---|---|
| 0.20 | 0.024 |
| 0.30 | 0.034 |
| 0.40 | 0.036 |

EXAMPLE 3

The dew point of the same cold rolled steel sheets as in Example 2 was controlled so that the oxidizing degree ($PH_2O/PH_2$) became constant, and the steel sheets were then subjected to annealing in the following three atmospheres: (a) 25% $N_2$+75% $H_2$, (b) 50% $N_2$+50% $H_2$, and (c) 75% $N_2$+25% $H_2$.

Thereafter, they were subjected to a nitriding treatment in a nitrogen atmosphere containing 3% of $NH_3$.

As shown in Table 3, the amount of increased nitrogen is determined by the oxidizing degree and does not depend on the atmosphere gas composition.

TABLE 3

| Oxidizing Degree ($PH_2O/PH_2$) | Atmosphere Gas | Amount of Increased Nitrogen (%) |
|---|---|---|
| 0.05 | (a) | 0.002 |
| | (b) | 0.002 |
| | (c) | 0.003 |
| 0.30 | (a) | 0.035 |
| | (b) | 0.038 |
| | (c) | 0.037 |

EXAMPLE 4

Slabs containing 3.2% of Si, 0.027% of Al acid soluble, 0.003% of N, 0.14% of Mn, 0.007% of S, 0.05% of C, the balance being Fe and accompanying impurities, were heated to 1150° C., and then were subjected to hot rolling to produce a hot rolled steel sheet having a thickness of 1.8 mm.

After the hot-rolled steel sheets were subjected to an annealing at 1100° C. for 2 min and 900° C. for 2 min, they were subjected to a cold rolling having a finishing thickness of 0.20 mm. The thus-obtained cold rolled steel sheets were subjected to a primary recrystallization annealing, also serving for the decarburization, at 830° C. while changing the atmosphere oxidizing degree. Then, a 5% ferromanganese nitride added annealing separator mainly composed of MgO was coated on the steel sheets for nitridation, and thereafter, a finishing annealing was effected by heating them to 1200° C. at a heating rate of 15° C./hours in an atmosphere of 25% $N_2$+75% $H_2$, and a purification at 1200° C. for 20 hours in an atmosphere of 100% $H_2$.

The amount of the increased nitrogen and the magnetic properties of the production are shown in Table 4.

TABLE 4

| Oxidizing Degree ($PH_2O/PH_2$) | Amount of Increased Nitrogen (%) | Magnetic Flux Density ($B_8$:Tesla) |
|---|---|---|
| 0.05 | 0.003 | 1.53 |
| 0.20 | 0.012 | 1.81 |
| 0.30 | 0.019 | 1.92 |
| 0.40 | 0.021 | 1.93 |
| 0.70 | 0.022 | 1.91 |
| 1.00 | 0.011 | 1.77 |

EXAMPLE 5

Slabs containing 3.2% of Si, 0.027% of Al acid soluble, 0.007% of N, 0.13% of Mn, 0.007% of S, 0.05% of C, the balance being Fe and accompanying impurities, were heated to 1150° C., and thereafter, were subjected to hot rolling to produce hot rolled steel sheets having a thickness of 1.8 mm.

Then the hot-rolled steel sheets were subjected to a two-step annealing process i.e., a first annealing at 1120° C. for 2 min and a second annealing at 900° C. for 2 minutes, and then to a cold rolling to obtain finish steel sheets having a thickness of 0.20 mm. Then the cold rolled steel sheet was subjected to a primary recrystallization annealing, wherein they were heated to 830° C. at the heating rate of 10° C./sec, 20° C./sec, 30° C./sec, and 40° C./sec under an atmosphere having oxidizing degree ($PH_2O/PH_2$) of 0.35 and maintained at 830° C. for 90 secs.

Then, after an annealing separator mainly composed of MgO, to which a 5% ferro-manganese nitride was added for nitriding the sheets, was coated and a finishing annealing was carried out.

The heating rates in the primary recrystallization annealing, the amounts of oxygen in the steel sheet after the primary recrystallization annealing, and the magnetic properties of the products i.e., the magnetic flux densities and the values of the watt loss obtained after carrying out the magnetic domain subdivisional treatment by 5 mm-gap irradiating the product with a laser, are shown in a Table 1.

TABLE 1

| | Heating Rate in Primary Recrystallization Annealing (°C./s) | Amount of Oxygen (ppm) | Magnetic Property: Magnetic Flux Density ($B_8$(T)) | Magnetic Property: Value of Watt Loss $W_{17/50}$ (W/kg) |
|---|---|---|---|---|
| present invention | 10 | 930 | 1.91 | 0.76 |
| | 20 | 940 | 1.92 | 0.74 |
| | 30 | 980 | 1.92 | 0.75 |
| comparative example | 40 | 1130 | 1.91 | 0.86 |

EXAMPLE 6

The same cold rolled steel sheet as in the example was subjected to a primary recrystallization annealing wherein the sheet was heated at a heating rate of 20° C./sec to 830° C., with various conditions of the oxidizing degree ($PH_2O/PH_2$) of atmosphere ranging from 0 15 to 0.8, and with a constant oxidizing degree of 0.35 for 90 secs at 830° C.

Then, after a nitriding treatment in which the amount of increased nitrogen of the steel sheet became 0.012% under an atmosphere containing ammonia, an annealing separator mainly composed of MgO was coated, and the steel sheet was subjected to a finishing annealing.

The oxidizing degrees ($PH_2O/PH_2$) of the atmosphere during heating in the primary recrystallization annealing, the amount of oxygen of the steel sheet after the primary recrystallization, and the magnetic properties of the product are shown in Table 2. In this case, the watt losses were measured by a laser irradiation.

TABLE 2

| | Oxidizing Degree of Atmosphere | Amount of Oxygen of Steel Sheet (ppm) | Magnetic Property: Magnetic Flux Density ($B_8$(T)) | Magnetic Property: Value of Watt Loss $W_{17/50}$ (W/kg) |
|---|---|---|---|---|
| Comparative Example | 0.15 | 1180 | 1.90 | 0.83 |
| Present Invention | 0.20 | 1100 | 1.92 | 0.77 |
| | 0.25 | 990 | 1.92 | 0.74 |
| | 0.35 | 940 | 1.92 | 0.74 |
| | 0.45 | 950 | 1.93 | 0.73 |
| | 0.60 | 1080 | 1.92 | 0.78 |
| | 0.80 | 1150 | 1.91 | 0.85 |

We claim:

1. A method of producing an oriented electrical steel sheet having superior magnetic properties, comprising the steps of: hot rolling a slab containing 0.8 to 6.8% of Si, 0.008% to 0.048% of Al acid soluble, the balance being Fe and accompanying impurities, by weight to form a strip, cold rolling the strip, primary-recrystallization annealing, coating the strip with an annealing separator, and finishing annealing, a nitriding treatment being effected after said primary recrystallization annealing but before the start of the secondary recrystallization of said finishing annealing, wherein an atmosphere oxidizing degree ($PH_2O/PH_2$) in the primary recrystallization annealing process is defined as within a range of from 0.15 to 0.80.

2. A method according to claim 1, wherein said slab is heated at 1000° to 1270° C. before hot rolling.

3. A method according to claim 2, wherein said hot rolled steel sheet is annealed, if necessary, at a temperature ranging from 750° to 1200° C., for 30 secs to 30 mins.

4. A method according anyone of claims 1, 2 or 3, wherein one or two or more cold rolling stages with annealing therebetween are carried out.

5. A method according to claim 1, wherein said atmosphere oxidizing degree ($PH_2O/PH_2$) in the annealing process is defined as 0.25 to 0.70.

6. A method according to claim 1, wherein an annealing separator mainly composed of MgO is used as said annealing separator.

7. A method according to claim 1 wherein a metal-nitride-added annealing separator is used as said annealing separator.

8. A method according to claim 7, wherein said metal nitride is manganese nitride or chromium nitride.

9. A method of producing an oriented electrical steel sheet having superior magnetic properties, comprising the steps of: hot rolling a slab containing 0.8 to 6.8% of Si, 0.008% to 0.048% of Al acid soluble, the balance being Fe and accompanying impurities, by weight to form a strip, cold rolling the strip, primary-recrystallization annealing, coating the strip with an annealing separator, and finishing annealing, a nitriding treatment being effected after said primary recrystallization annealing but before the start of the secondary recrystallization of said finishing annealing, wherein with an atmosphere oxidizing degree ($PH_2O/PH_2$) x in a soaking process in said primary recrystallization annealing, an annealing is effected in an atmosphere having an oxidizing degree ($PH_2O/PH_2$): y in a range defined by the following inequality, at a temperature ranging from 650° to 800° C. in the heating process, for at least 5 secs, $$0.15 \leqq x \leqq 0.80$$
$$0.15 \leqq y \leqq 0.80$$
$$0.16x + 0.11 \leqq y \leqq -0.41x + 0.78.$$

10. A method according to claim 9 wherein said slab is heated at 1000° to 1270° C. before hot rolling.

11. A method according to claim 10, wherein said hot rolled steel sheet is annealed, if necessary, at a temperature ranging from 750° to 1200° C., for 30 secs to 30 mins.

12. A method according to anyone of claims 9, 10 or 11 wherein one or two or more cold rolling stages with annealing therebetween are carried out.

13. A method according to anyone of claims 9, 10 or 11 wherein said atmosphere oxidizing degree ($PH_2O/PH_2$) in the annealing process is defined as 0.25 to 0.70.

14. A method according to claim 9, wherein an annealing separator mainly composed of MgO is used as said annealing separator.

15. A method according to claim 9, wherein a metal-nitride-added annealing separator is used as said annealing separator.

16. A method according to claim 15, said metal nitride is manganese nitride or chromium nitride.

* * * * *

UNITED STATES PATENT AND TRADEMARK OFFICE

CERTIFICATE OF CORRECTION

PATENT NO. : 5,082,509

DATED : January 21, 1992

INVENTOR(S) : Yoshiyuki USHIGAMI, et al.

It is certified that error appears in the above-identified patent and that said Letters Patent is hereby corrected as shown below:

ABSTRACT, line 4, change "0.008%" to --0.048%--.

Column 1, line 47, change "p. 769-781)" to --pp. 769-781)--.

Column 1, line 55, change "propose" to --proposes--.

Column 1, line 56, change "P" to --pp.--.

Column 1, line 64, change "p." to --pp.--.

Column 1, line 65, change "419-424" to --419-424)--.

Column 2, line 61, change "form" to --forms--.

Column 2, line 65, change "state." to --state,--.

Column 2, line 66, change "An" to --an--.

Column 3, line 42, change "($PH_2O/PH_2$)" to --($PH_2O/PH_2$):--.

Column 3, line 53, change "(increased nitrogen level" to --(increased nitrogen level)--.

Column 4, line 58, between "problem" and "arises" delete "is".

UNITED STATES PATENT AND TRADEMARK OFFICE

CERTIFICATE OF CORRECTION

PATENT NO. : 5,082,509

DATED : January 21, 1992

INVENTOR(S) : Yoshiyuki USHIGAMI, et al.

It is certified that error appears in the above-identified patent and that said Letters Patent is hereby corrected as shown below:

Column 4, line 61, after "oxygen" (first occurrence), insert a comma.

Column 5, line 48, between "of" and "the uniform" delete "in".

Column 6, line 15, after "less" insert --than--.

Column 6, line 45, change "reside" to --resides--.

Column 10, line 33, between "in" and "Table 1." delete "a".

Column 10, line 54, change "0" to --0.--.

Column 11, line 41, between "according" and "anyone" insert --to--.

UNITED STATES PATENT AND TRADEMARK OFFICE

CERTIFICATE OF CORRECTION

PATENT NO. : 5,082,509

DATED : January 21, 1992

INVENTOR(S) : Yoshiyuki USHIGAMI, et al.

It is certified that error appears in the above-identified patent and that said Letters Patent is hereby corrected as shown below:

Column 12, line 17, change "$(PH_2O/PH_2)$" to --$(PH_2O/PH_2)$:--.

Signed and Sealed this

Fifteenth Day of June, 1993

*Attest:*

*Attesting Officer*

Michael K. Kirk

MICHAEL K. KIRK

*Acting Commissioner of Patents and Trademarks*